United States Patent [19]

Coutu, Sr.

[11] Patent Number: 4,503,644

[45] Date of Patent: Mar. 12, 1985

[54] ROOF CONSTRUCTION

[76] Inventor: Walter H. Coutu, Sr., 110 Nagog Hill Rd., Acton, Mass. 01720

[21] Appl. No.: 493,005

[22] Filed: May 9, 1983

[51] Int. Cl.[3] ..... E04D 13/00

[52] U.S. Cl. ..... 52/13; 52/608; 52/DIG. 10

[58] Field of Search ..... 52/13, 608, DIG. 10

[56] References Cited

U.S. PATENT DOCUMENTS

| | | |
|---|---|---|
| 465,064 | 12/1891 | Loomis . |
| 1,951,090 | 11/1931 | Goodrich . |
| 3,090,162 | 5/1963 | Baroni . |
| 4,014,145 | 3/1977 | Groves . |

FOREIGN PATENT DOCUMENTS

| | | | |
|---|---|---|---|
| 6803014 | 9/1969 | Netherlands | 52/DIG. 10 |

OTHER PUBLICATIONS

"Tapered Perlite Roof Systems" 7.15/Oak Oakway.
"Insulfoam Western Insulfoam Corporation Construction Products".
"The Benoit System Tapered Foam Roof Insulation".

*Primary Examiner*—Carl D. Friedman
*Attorney, Agent, or Firm*—Hamilton, Brook, Smith and Reynolds

[57] ABSTRACT

A construction block having a base, at least one top surface which slopes toward and intersects the base and at least two sides characterized by: at least one right angle corner of finite thickness defined by the intersection of the two sides; two diametrically opposite corners of equal height each of which lie in the plane of one of the two sides; and at least one point at the intersection of the top surface and the base which has zero thickness.

4 Claims, 15 Drawing Figures

ROOF CONSTRUCTION

DESCRIPTION

1. Technical Field

This invention relates to building construction and more particularly to providing means for draining collected water from what are normally considered flat roofs.

2. Background of the Invention

Rain water and melted snow tend to collect in puddles or ponds on the surface of flat roofs. This is obviously detrimental for a number of reasons. The weight of the water can induce roof collapse, and its presence on the roof contributes to the premature deterioration of the roofing materials due to seepage through tiny cracks (induced by repeated freezing and thawing). The collection of dirt in the cracks and in the water contributes to the extra weight on the roof as well as promoting plant growth.

An obvious and well-known solution to the problem is to make what would otherwise be a "flat" roof into one which is sloping. A roof which comprises a single plane, sloped in one direction directs all water to one side of the building for easy drainage. If the building is large in area, it necessitates a pitch of considerable size from side to side, rendering the building aesthetically unbalanced and requiring extensive supporting understructure.

A better alternative has been developed by providing drains in the central or inner areas of the roof at selected places and by building up areas of the roof and sloping them toward the drainage areas. This has been accomplished by constructing an essentially flat, horizontal roof of structural steel or wood, covering it with a first flat base and then overlaying the base with upwardly sloping projections known in the building trade as crickets or sometimes saddles when crickets are used in combination. Generally speaking, they are pentahedrons having four triangular sides projecting from a substantially diamond-shaped base.

The saddles are positioned on the roof to cause water to flow toward strategically located drain holes. Some roofs require only one cricket. Long narrow buildings frequently require a line of crickets separated by drain holes, and large buildings require a plurality of crickets positioned in predetermined patterns over the surface of the roof.

With the development of modern roofing materials and construction techniques it has become a common practice to combine insulating material such as urethane, polystyrene or perlite with the structural material. Frequently the insulating material is supplied in rectangular blocks or slabs often two feet by four feet in area. The slabs are laid or piled up in selected areas on a sub-roof supported by structural steel or wood in various combinations and thicknesses to build crickets in the form of pyramids. This provides an overall water flow generally downwardly and inwardly from the roof perimeter toward drainage holes. The crickets are fabricated on the building site by either cutting up blocks of uniform or tapering thickness laid one upon another. They are then trimmed to fit. This is obviously a labor intensive operation.

U.S. Pat. No. 4,014,145 which issued Mar. 29, 1977 to John L. Groves of Flint, Mich. discloses a roof having a plurality of saddles or crickets which are pentahedrons aligned one with another and separated by drain holes. The crickets are built up of a plurality of rectangular blocks of uniform thickness and rectangular blocks which are uniformly tapered from one side to another. The blocks are assembled in overlapping relationship and then trimmed where needed, not only to form a point on the diamond-based pentahedron but where adjacent blocks are butted together at angles other than right angles. This results not only in an additional on-site labor step but in wastage of the material from which the blocks are made.

It is a principle object of this invention to provide prefabricated building blocks for the formation of roof crickets which require no on-site or in-the-field trimming.

It is also an object of this invention to provide building blocks or slabs for a roof cricket whereby a single original block may be cut to provide at least two building blocks which may each be used in their entirety without wastage in the forming of a roof cricket.

DISCLOSURE OF THE INVENTION

The invention resides in prefabricated building blocks. Beginning with a rectangular block of predetermined thickness, separating it into two blocks usable in their entirety by dividing the original block by a single compound biased cut beginning at the top of the block and downwardly through it at a compound angle until two usable building blocks of predetermined configuration are provided. In one of its embodiments the invention results in a construction block having a base, at least one top surface sloping toward and intersecting the base and at least two sides, which block is characterized by at least one right angle corner of finite height being defined by the intersection of the two sides and two diametrically opposite corners of equal height which each lie in the plane of one of the two sides and at least one point at the intersection of the top surface and the base which has zero thickness. The zero thickness point may be a corner diametrically opposite the right angle corner or any point on a line constituting the hypotenuse of a triangle defined by the base and the intersecting top surface.

Depending upon the thickness of the block, a similar cut made in a thicker block will produce a construction block having a base, at least one top surface sloping with respect to the base, but not necessarily intersecting it and at least two sides which block is characterized by at least one right angle corner defined by the intersection of the two sides and two diametrically opposite corners of equal height and of a finite number of units, each of which corner lies in the plane of one of the two sides, and a fourth corner diametrically opposite the right angle corner which has a height one unit less than the height of the two equal corners.

Depending on the thickness of the block, there are always two diametrically opposite corners of equal height and one corner of less height (which can be zero).

Since the initial block is a rectangle, when there is a differential between the right angle corner and the diametrically opposite corners, its height is one unit greater than the height of the opposite corners and the fourth corner i.e., the right angle corner is always one unit less than the height of the diametrically opposed corners of equal height.

Thus there is produced a plurality of building blocks which may be assembled adjacent to and or superimposed on one another to produce a roof cricket which for illustrative purposes will be shown as a tetrahedron having a diamond-shaped base and four equal triangular sides.

The above and other features of the invention including various novel details of construction and combinations of parts will now be more particularly described with reference to the accompanying drawings and pointed out in the claims. It will be understood that the particular building blocks and roof crickets embodying the invention are shown by way of illustration only and not as limitations of the invention. The principles and features of this invention may be employed in varied and numerous embodiments without departing from the scope of the invention.

BEST MODE OF THE INVENTION

Figure 1:
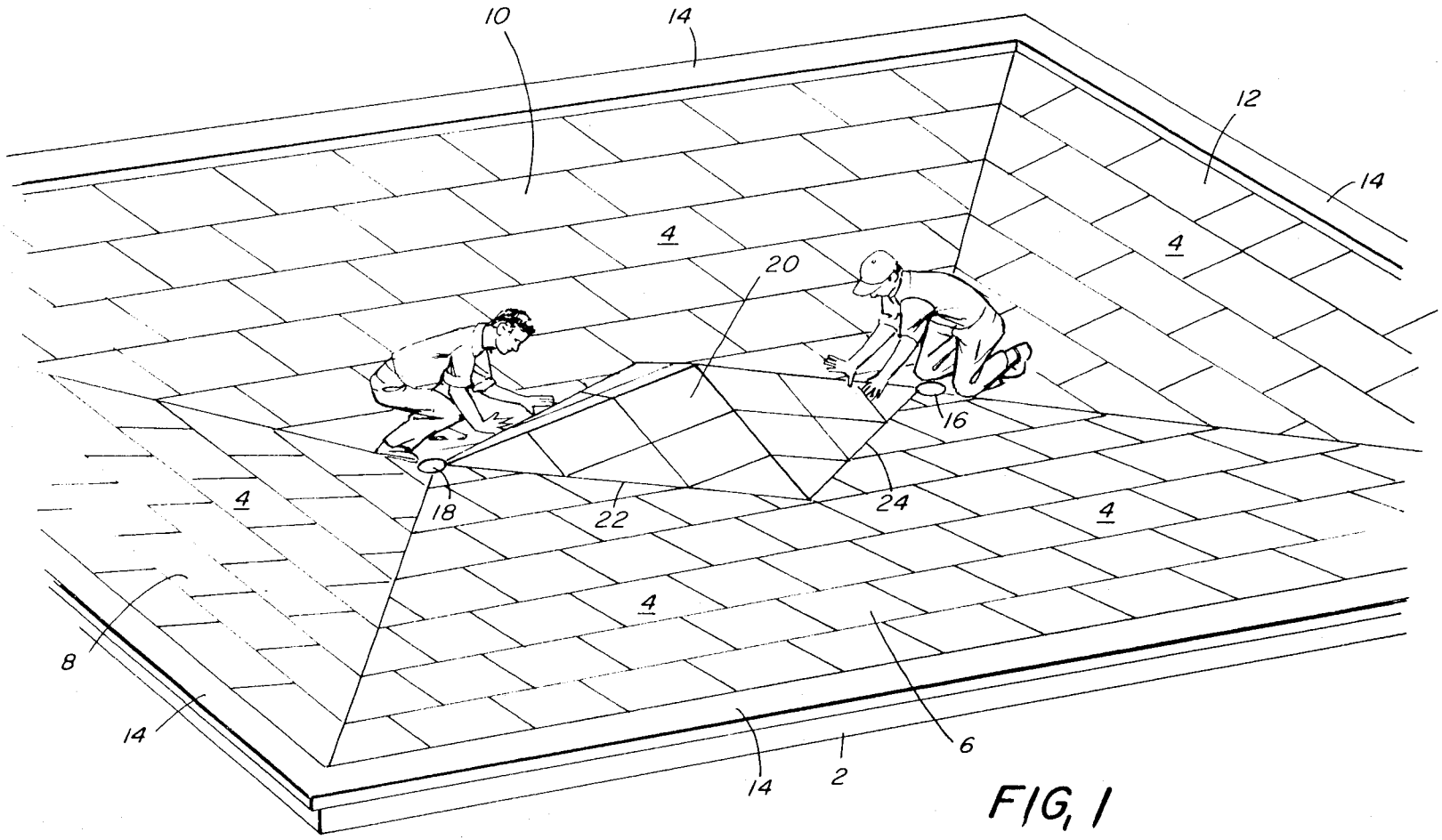
FIG. 1 is a perspective view, with parts broken away, of a roof with a cricket under construction.

FIG. 1 shows a roof under construction which comprises a supporting roof structure 2 which may be of any conventional materials ranging from structural steel or wooden beams covered with rough planking or plywood. It is overlaid with rectangular blocks or slabs of insulation 4 which are precut and assembled to provide a flat configuration. As an alternate as shown in somewhat exaggerated fashion in FIG. 1, the blocks may be arranged in general areas 6, 8, 10, and 12, sloping slightly downwardly and inwardly from the roof periphery 14. The areas 6, 8, 10, and 12 are often built up through conventional construction and lead toward a pair of drains 16 and 18 formed at the intersection of each of three of the four general areas. Centrally located in the roof between the drain holes 16 and 18 is a cricket 20 constructed in accordance with the present invention.

The blocks of insulation 4 from which the roof areas 6, 8, 10, and 12 and those from which the cricket 20 are made are secured in conventional fashion by adhering them with asphalt or by other adhesive material to the subroofing. The insulation is subsequently coated with asphalt or the like and may be overlaid with tarred felt which in turn may be covered with asphalt and gravel. Regardless of the technique employed in creating the final surface, it is the technique of creating the contoured cricket which is the subject of this invention. If the roof is constituted as shown in FIG. 1 with the panels 6, 8, 10 and 12 all sloping toward the drain holes, because the sides of the cricket all slope downwardly, the intersections 22,24 each slope toward a drain hole to direct water into them. If the roof is flat, just the cricket serves to direct water flow.

Figure 2:
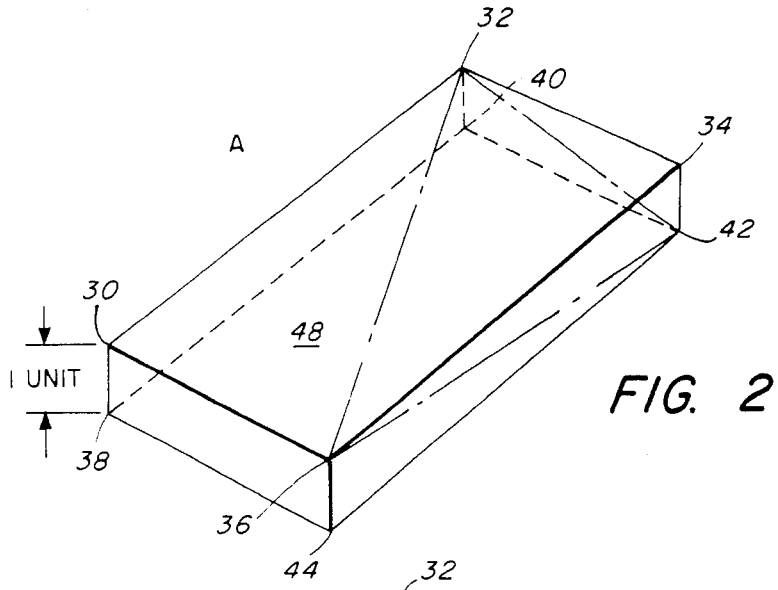
FIG. 2 is a perspective view of a rectangular building block which when cut in accordance with the teachings of this invention results in blocks as shown in FIGS. 2A and 2B.
Figure 2A:
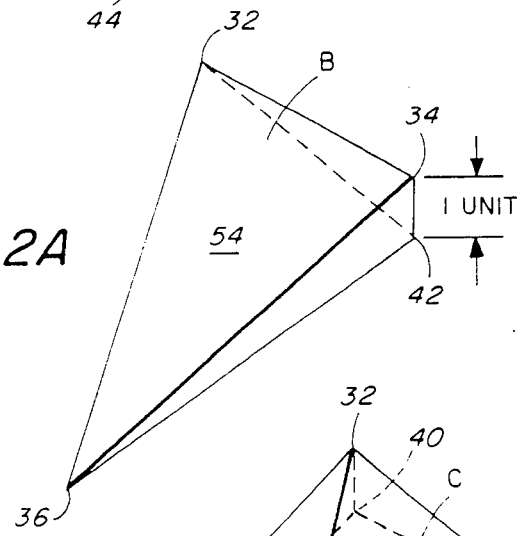
Figure 2B:
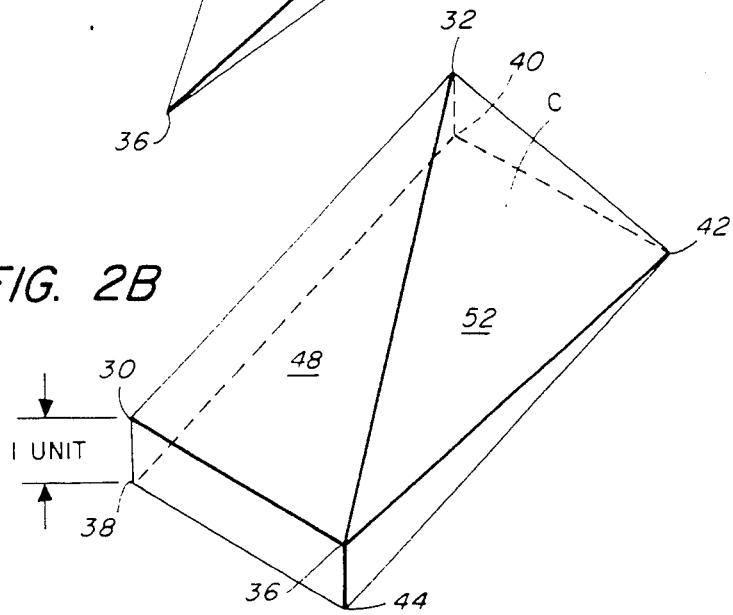

Referring next to FIGS. 2, 2A, and 2B, the first of a plurality of cricket building blocks will now be described. FIG. 2 shows a rectangular block of building material such as perlite, urethane or polystyrene. The actual dimensions of the rectangular block are immaterial although one commercial size is two feet by four feet and of varying thickness.

The rectangular block A is bounded by four upper corners 30, 32, 34, and 36, and four lower corners 38, 40, 42, and 44. It is of one unit thickness. A compound cut is made starting in the upper surface 48 along the diagonal line 32–36. The cut is planar and extends downwardly to the bottom corner 42 where it feathers to zero thickness. This results in two blocks, B and C shown in FIGS. 2A and 2B respectively.

Block B has a right triangular base 32, 36, 42. Projecting upwardly from the base is a right angle corner 42,34 which has a finite thickness of one unit. It also has two diametrically opposite corners 32 and 36 which together with the corner 34 define an upper triangular surface 54; the line 32–36 is the intersection between the top surface 54 and the base. Consequently the corners 32 and 36 as well as any point along the line intersecting them are points of zero thickness.

Block C will now be described. It is rectangular in plan view having a rectangular base 38, 40, 42, 44. It retains half of the original upper surface 48 which is now a right triangle 30,32,36 and exhibits a new sloping surface 52 defined by the corners 32, 42, 44. The block has a right angle corner 30, 38 which is of one unit thickness. It includes at least two sides 30,32,40 and 38 and 30,36,44,38 which intersect at the right angle corner 30,38. The new top surface 52 intersects the base at point 42 which is naturally a point of zero thickness.

Figure 3:
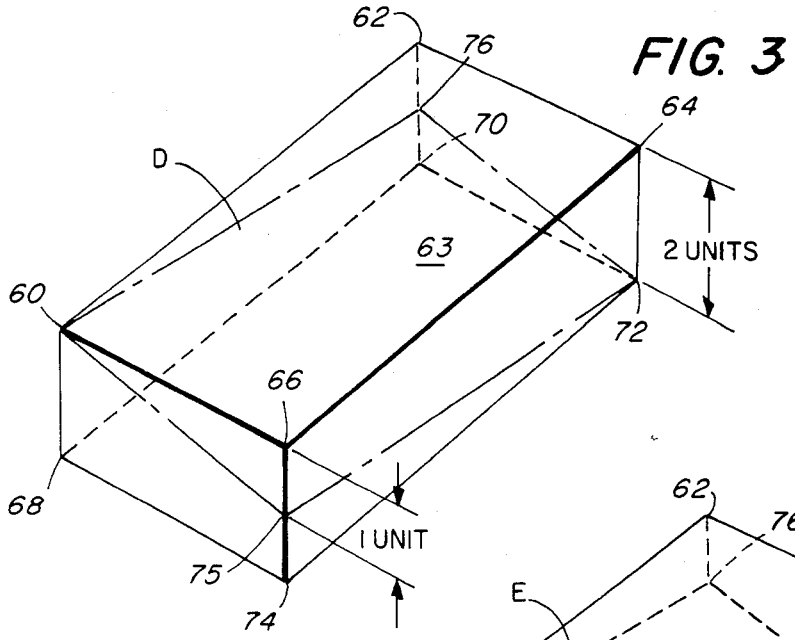
FIG. 3 is a perspective view of a rectangular building block which when cut in accordance with the teachings of this invention results in building blocks as shown in FIGS. 3A and 3B.
Figure 3A:
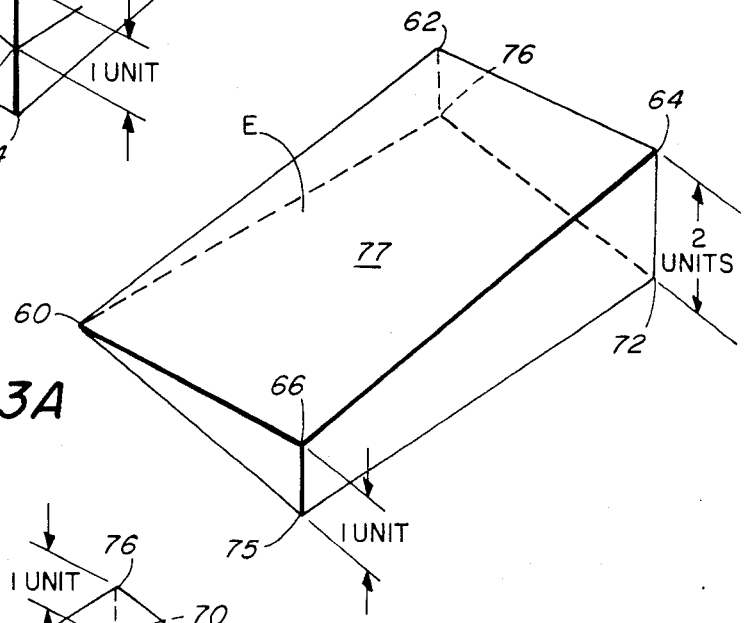
Figure 3B:
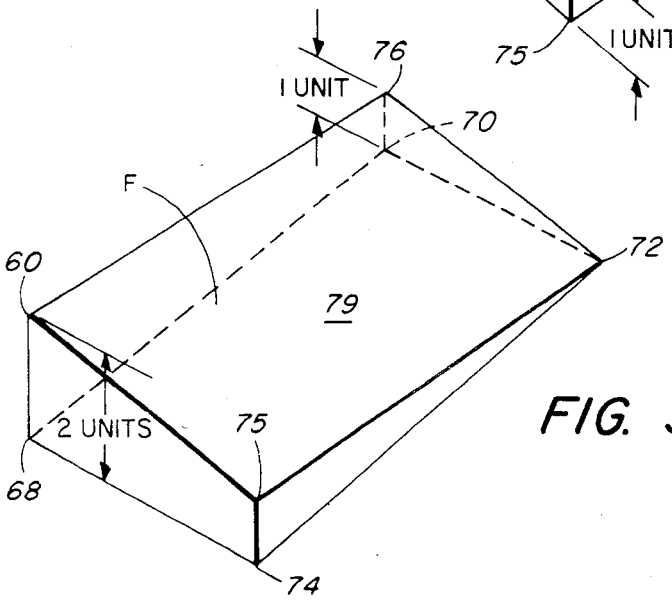

Referring next to FIGS. 3, 3A, and 3B there will be seen an initial rectangular block D of two units thickness defined by corners 60,62,64,66 and lower corners 68, 70, 72, and 74. Starting at corner 60 in the upper surface 63 a single planar cut is made through to the lower base corner 72. The cut intersects the line 62–70 at its midpoint 76 and the line 66,74 at its midpoint 75.

This results in two identical building blocks E and F. Block E includes a right angle corner 64,72 of two units thickness, diametrically opposite equal corners 62,76 and 66,78 of one unit thickness each and it tapers to a point 60 of zero thickness. It includes sides 62,64,72,76 and 64,72,78,66 intersecting at the right angle corner 64,72 and also a top surface 77.

The block 3B will be seen to have a right angle corner of two units thickness, two diametrically opposite corners 70, 76 and 75, 74 each of one unit thickness and a point 72 diametrically opposite the right angle corner 60, 68 which has zero thickness, that is, the point where the upper surface 79 intersects the base of block F. Block E equals Block F.

Figure 4:
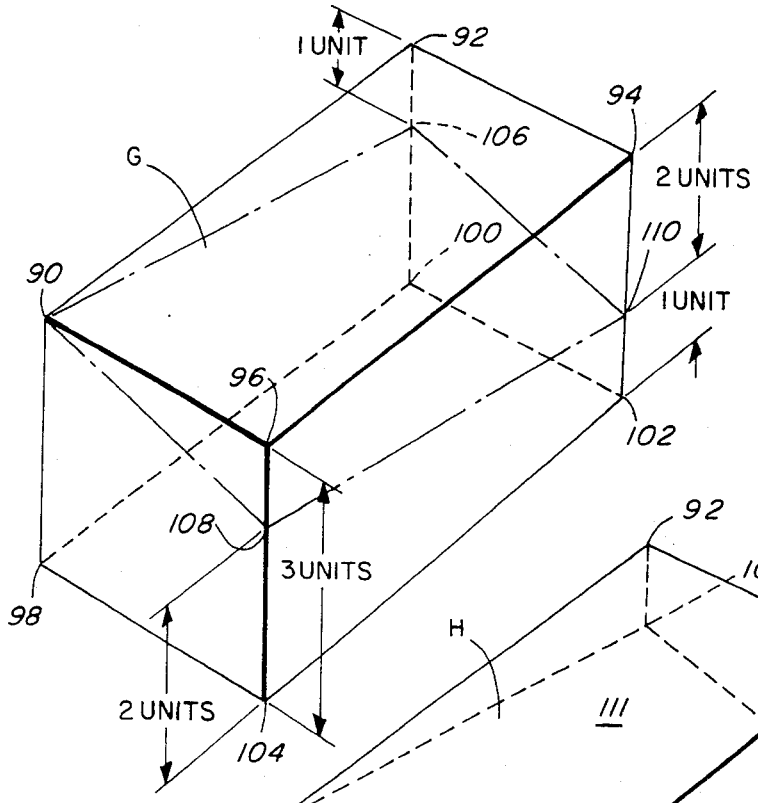
FIG. 4 is a perspective view of a rectangular building block which when cut in accordance with the teachings of this invention results in buildings blocks shown in FIGS. 4A and 4B.
Figure 4A:
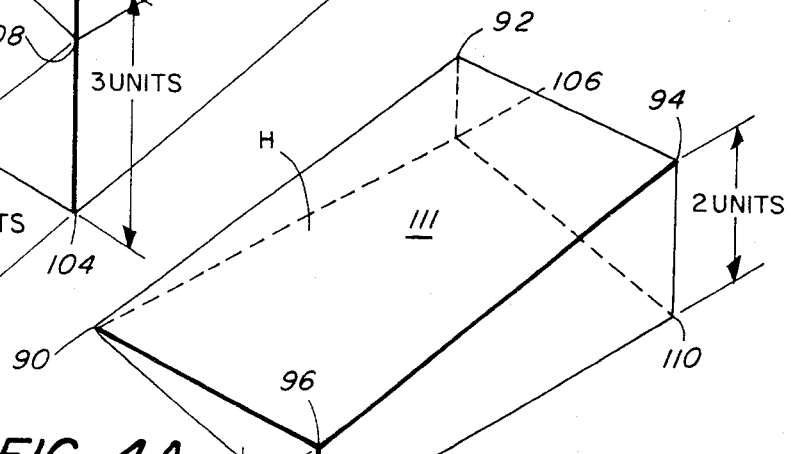
Figure 4B:
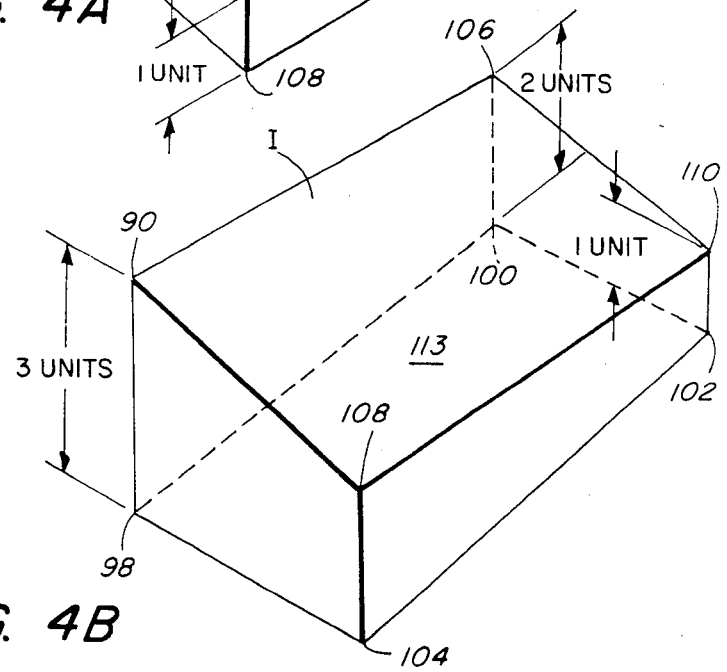

Referring next to FIGS. 4, 4A and 4B there will be seen a right rectangular block G of three units thickness defined by top corners 90, 92, 94, 96 and bottom corners 98,100, 102 and 94. Beginning at corner 90 a planar cut is made which intersects line 92–100 at point 106 which is one unit down from point 92 and two units up from point 100. It likewise intersects corner 96–104 at point 108 which likewise is one unit from the top of the block and two units from the bottom. It intersects corner 94–92 at a point two units from the top and one unit from the bottom.

This results in blocks 4A and 4B. It will be noted that block 4A has a right angle corner 94–110 of two units thickness, two diametrically opposite corners 92–106 and 96–108 of one unit thickness and a corner 90 which is diametrically opposite the right angle corner which has zero thickness where the top 111 intersects the base. Block H is identical to Blocks E and F.

Block I will be seen to have a right angle corner of three units thickness, two diametrically opposite corners 106–100 and 104–108 each of which is two units thick and a corner 102–110 diametrically opposite the right angle corner which has a thickness of one unit.

From the foregoing, it will be evident that successively larger blocks may also be cut in the same fashion to produce sloping building blocks of ever-increasing thickness. The right angle corner will always be one unit larger than the two diametrically opposite corners which will have the same thickness. The fourth corner which is opposite the right angle corner will always have a thickness of one unit less than the two diametrically opposite corners.

Figure 5:
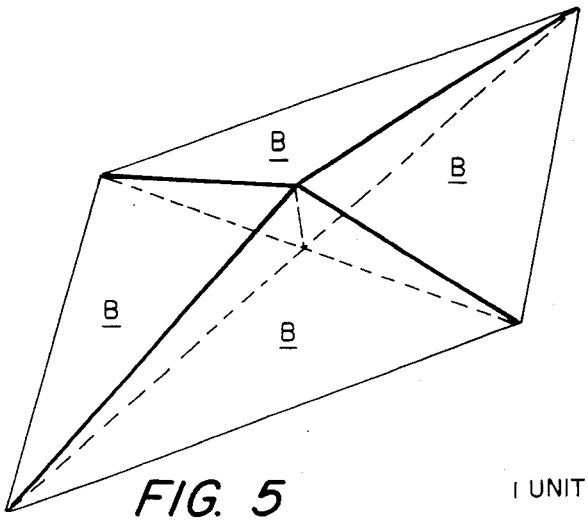
FIG. 5 is a perspective view of a simple roof cricket made with blocks shown in FIG. 2A and FIGS. 6–8 are perspective views of half crickets constructed of various blocks made in accordance with this invention.

The simplest form of full cricket to be made from the above-described building blocks is shown in FIG. 5. It is a tetrahedron having a diamond-shaped base and four downwardly sloping sides. It is made from four B blocks assembled with their right angle corners in the center.

Figure 6:
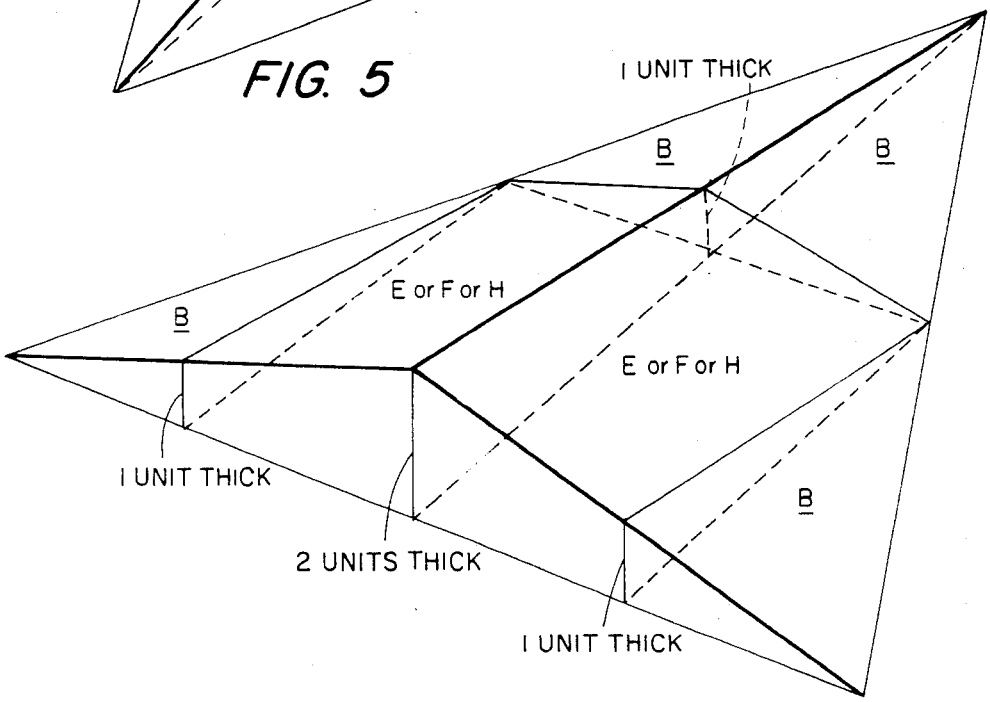

FIG. 6 discloses a slightly larger half cricket formed of four B blocks and two interior blocks which may be blocks E, or F or H since they are identical. The B blocks form the apex and the edges.

Figure 7:
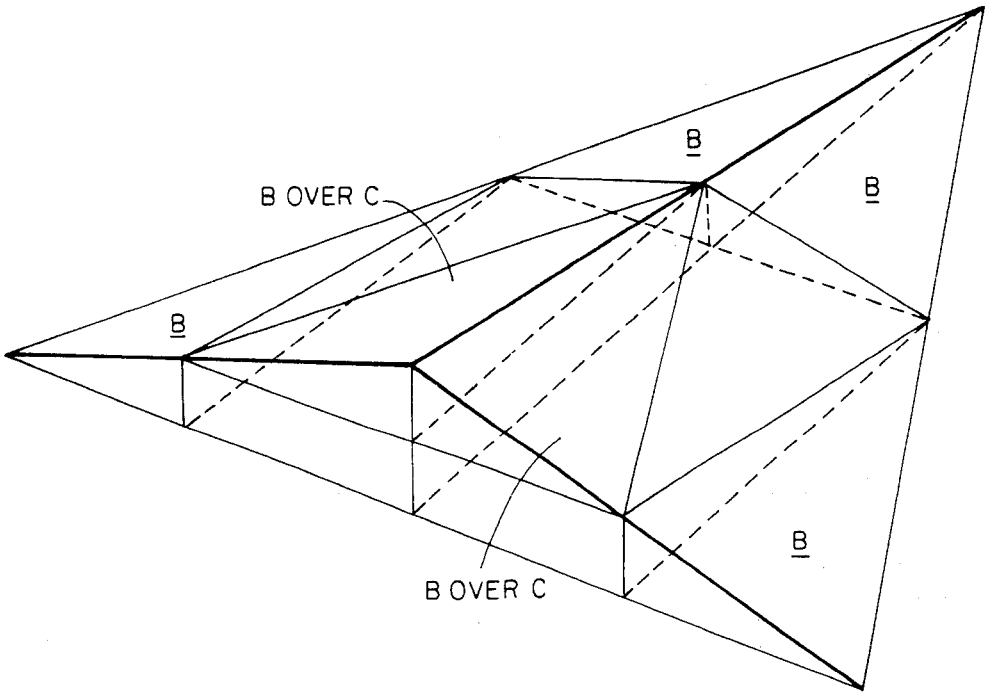

Referring next to FIG. 7, a cricket the same size and shape as that shown in FIG. 6 will be seen. It employs two B blocks at the apex and two at the edges, but the interior portion is made by placing a B block over a C block as a base.

Figure 8:
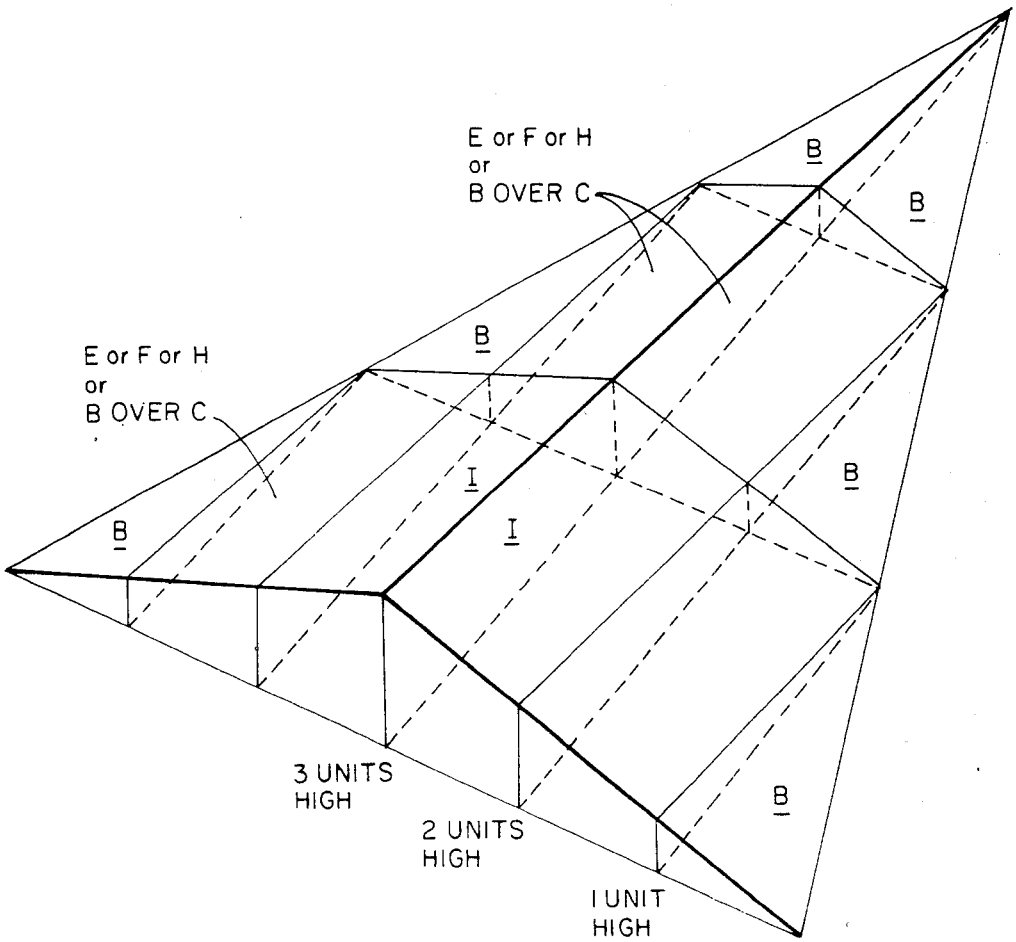

FIG. 8 shows a longer cricket having three rows of building blocks. Again the apex made up of two B blocks adjacent to each other. The next row comprises B blocks at the edges and the interior structure of an E or F or H block or the combination of a B block over a C block as shown in FIG. 7. In addition, it includes a third row employing in the central area a pair of I blocks side by side. This produces a cricket which is three units high at the central apex.

Figure 9:
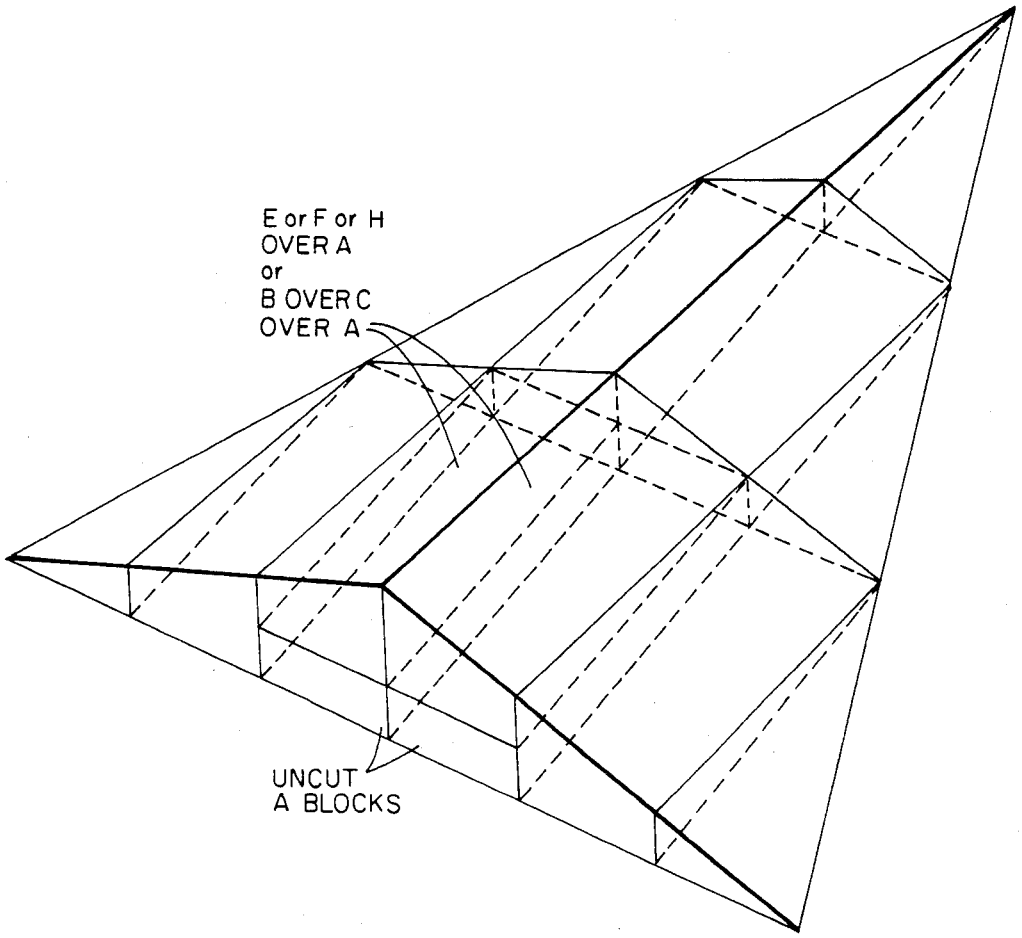

FIG. 9 shows a cricket the same size and shape as FIG. 8 with the exception of the central blocks comprising a composite built upon an underlayer of two A blocks as shown, covered by either an E, F or H block or a stack comprising a B over C over A as a base.

Thus it will be seen there is absolutely no wastage of construction material starting with rectangular blocks of uniform thickness by cutting in accordance with the teachings of this invention. Every block is usable depending on the configuration of the cricket desired to be made without wastage or without the requirement of on-site trimming. While in the illustrative examples the crickets are built upon a flat surface and are in complete engagement one with the other, were the roof one which is pitched downwardly and inwardly as shown in FIG. A, the central line of blocks would be merely spread slightly from one another and any ensuing gaps filled with asphalt or other adhesive material.

This results in two blocks with the following dimensions. Block H which is scrived to a feather edge at point 90 is one unit high at the corner 92–96, also one unit high at the corner 96–108 and two units high at the opposite diagonal corner 94–110.

Block I is three units high at the edge 90–98, two units high at each of the corners 106, 100, and 90–108 and one unit high at the opposite diagonal corner 110–122.

I claim:

1. A construction block having a base, at least one top surface which slopes toward the base and at least two sides characterized by:

a. a first right angle corner of finite thickness defined by the intersection of the two sides;

b. two diametrically opposite corners of equal thickness each of which lies in the plane of a separate side;

c. a second right angle corner diametrically opposite the first corner; and d. wherein the thickness of the diametrically opposite corners is a finite number of units each and the thickness of the right angle corner of finite thickness is one unit greater than that of the opposite corners and the thickness of the said second right angle corner is one unit less than that of the opposite corners.

2. A construction block having a base, at least one top surface sloping toward the base and at least two sides characterized by:

a. at least one right angle corner of a finite number of units of thickness defined by the intersection of the two sides;

b. two diametrically opposite corners each having a finite number of units of thickness not greater than that of the right angle corner and which corners lie in the planes of separate sides;

c. a fourth corner diametrically opposite the right angle corner having a thickness of one unit less than the thickness of the two equal corners; and d. wherein the thickness of the right angle corner is one unit greater than that of the opposite corners.

3. A rectangular construction block comprising two separate portions X and Y separated by a single compound bias cut and joined together, portion X comprising a solid having:

a. a top surface, a base, two sides and at least one right angle corner of finite thickness defined by the intersection of the said two sides;

b. two diametrically opposite corners of equal height which each lie in the plane of a separate side; and c. at least one point at the intersection of the top surface and the base which has zero thickness;

portion Y comprising a solid having:

a. at least one right angle corner of a finite number of units of thickness defined by the intersection of the two sides;

b. two diametrically opposite corners each having a finite number of units of thickness not greater than that of the right angle corner and each of which corners lie in the planes of separate sides;

c. a fourth corner diametrically opposite the right angle corner having a thickness one unit less than the thickness of the two equal corners; and d. wherein the thickness of the right angle corner is one unit greater than that of the opposite corners.

4. A roof cricket comprising a pentahedron having four triangular sides projecting from a substantially diamond-shaped base made from the construction block portions of claim 3.

* * * * *